US012577764B2

(12) United States Patent
L'Henaff et al.

(10) Patent No.: US 12,577,764 B2
(45) Date of Patent: Mar. 17, 2026

(54) KITCHEN SINK SYSTEM WITH MULTIPLE FEATURES

(71) Applicant: AS America, Inc., Piscataway, NJ (US)

(72) Inventors: Jean-Jacques L'Henaff, New Canaan, CT (US); Ki Bok Song, Plainview, NY (US); Jacob Nitz, London (GB); Alison J. Lyons, Jersey City, NJ (US); Paul Flowers, London (GB); Greg Reinecker, Brooklyn, NY (US)

(73) Assignee: AS America, Inc., Piscataway, NJ (US)

( * ) Notice: Subject to any disclaimer, the term of this patent is extended or adjusted under 35 U.S.C. 154(b) by 65 days.

(21) Appl. No.: 18/687,597

(22) PCT Filed: Sep. 2, 2022

(86) PCT No.: PCT/US2022/075937

§ 371 (c)(1),
(2) Date: Feb. 28, 2024

(87) PCT Pub. No.: WO2023/034985

PCT Pub. Date: Mar. 9, 2023

(65) Prior Publication Data

US 2024/0426088 A1 Dec. 26, 2024

Related U.S. Application Data

(60) Provisional application No. 63/240,769, filed on Sep. 3, 2021.

(51) Int. Cl.
*E03C 1/04* (2006.01)
*A47L 15/00* (2006.01)
(Continued)

(52) U.S. Cl.
CPC ..... *E03C 1/04* (2013.01); *A47L 15/0086* (2013.01); *A47L 15/4278* (2013.01);
(Continued)

(58) Field of Classification Search
CPC ..... E03C 1/04; E03C 1/182; A47L 15/0086; A47L 15/4278; A47L 15/486; A47L 15/501
See application file for complete search history.

(56) References Cited

U.S. PATENT DOCUMENTS 2,669,240 A 2/1954 Thorson
9,574,333 B2 2/2017 O'Brien et al.
(Continued)

FOREIGN PATENT DOCUMENTS

CN 102697436 A 10/2012
CN 102697436 B * 7/2015
(Continued)

OTHER PUBLICATIONS

Translation (Year: 2025).*
(Continued)

*Primary Examiner* — Janie M Loeppke
(74) *Attorney, Agent, or Firm* — Morrison & Foerster LLP

(57) ABSTRACT

Provided are kitchen sink systems comprising one or more additional features for rinsing, cleaning, and/or drying. The one or more additional features can include a microbubble feature for rinsing produce, a rinsing feature for quickly and efficiently rinsing an item (e.g., dish or user's hands), a steam cleaning feature for cleaning an item (e.g., knife), and/or a retractable nozzle feature for efficiently drying and/or rinsing an item (e.g., drinking glass).

21 Claims, 10 Drawing Sheets

(51) Int. Cl.

| | |
|---|---|
| ***A47L 15/42*** | (2006.01) |
| ***A47L 15/48*** | (2006.01) |
| ***A47L 15/50*** | (2006.01) |
| ***E03C 1/182*** | (2006.01) |

(52) U.S. Cl.
CPC ..... *A47L 15/486* (2013.01); *A47L 15/501* (2013.01); *E03C 1/182* (2013.01)

(56) References Cited

U.S. PATENT DOCUMENTS

| | | | | |
|---|---|---|---|---|
| 9,783,967 | B2 | 10/2017 | Jain et al. | |
| 11,129,501 | B2 | 9/2021 | Detlaff | |
| 11,844,481 | B2 * | 12/2023 | Welling | E03C 1/182 |
| 2010/0275369 | A1 | 11/2010 | Eilmus et al. | |
| 2011/0219535 | A1 | 9/2011 | Bouroullec et al. | |
| 2012/0266377 | A1 | 10/2012 | Eilmus | |
| 2020/0107694 | A1 * | 4/2020 | Kwong | A47L 15/0076 |

FOREIGN PATENT DOCUMENTS

| | | | |
|---|---|---|---|
| KR | 10-2009-0053974 | A | 5/2009 |
| WO | 2019/113160 | A1 | 6/2019 |

OTHER PUBLICATIONS

The Ambient (Jun. 13, 2018). "Electrolux's future kitchen concepts are hidden, helpful and human sensing," located at https://www.the-ambient.com/features/electrolux-future-kitchen-concepts-684; 12 pages.

* cited by examiner

KITCHEN SINK SYSTEM WITH MULTIPLE FEATURES

CROSS-REFERENCE TO RELATED APPLICATIONS

This application is a U.S. national stage application under 35 U.S.C. § 371 of International Application No. PCT/US2022/075937, filed internationally on Sep. 2, 2022, which claims the benefit of U.S. Provisional Application No. 63/240,769, filed Sep. 3, 2021. The entire contents of each priority application is incorporated herein by reference.

FIELD

The present disclosure generally relates to kitchen sink systems, and in particular, to kitchen sink systems having a plurality of features including, but not limited to, a microbubble feature for rinsing food, a rinsing feature for easily rinsing dishes, a steam cleaning feature, and/or a retractable nozzle feature for drying and/or rinsing dishes.

BACKGROUND

Conventional kitchen sink systems include, at a most basic level, a faucet, a sink basin to receive water from the faucet, and a drain for water to exit the sink basin. A conventional kitchen sink is generally used for washing dishes and food preparation. Conventional sink systems require a user to utilize additional tools and/or space to rinse/clean food and items (e.g., utensils) and dry dishes.

SUMMARY

Provided herein are kitchen sink systems that include one or more features (e.g., cleaning, rinsing, and/or drying features) in addition to the standard water faucet. For example, additional features may include a microbubble feature that can be used for rinsing produce to remove dirt and other debris, a rinsing feature for quickly rinsing dishes, a steam cleaning feature for cleaning a utensil (e.g., knife) and/or a retractable nozzle feature for efficiently drying and/or rinsing a dish (e.g., drinking glass). Kitchen sink systems comprising one or more of the features provided herein can provide a more efficient user experience by minimizing the number of tools needed to wash, rinse, dry, and/or clean. Further, a user can also save time by using the kitchen sink systems provided herein to wash, rinse, dry, and/or clean, since the features integrated into the kitchen sink system allow the user to complete such tasks without having to walk away from the kitchen sink system.

One such feature may be a microbubble feature. A microbubble feature can dispense air bubbles into a sink basin that, in combination with water in the sink basin, can generate vibration that can remove dirt and debris from produce. In some embodiments, the produce can be placed into a colander and then into a sink basin of the kitchen sink system for rinsing. In some embodiments, the colander may be complementary in size and shape to the sink basin, such that the colander is configured to rest snugly within the sink basin. Thus, the sides of the colander may be proximate to each of the sides of the sink basin in which it is configured to be placed. The microbubble feature may be activated by actuating an actuating mechanism (e.g., a button). When activated, air bubbles are dispensed from a plurality of nozzles located in at least one side of the sink basin.

Another additional feature of kitchen sink systems provided herein can include a rinsing feature. The rinsing feature may include a plurality of nozzles in one or more side surfaces of a sink basin. When an actuating mechanism is actuated, water may be dispensed from the plurality of nozzles, forming a horizontal, or slightly angled, array (or "curtain") of water streams. An item to be rinsed (e.g., dish, user's hands) may be placed in the array (or "curtain") of water streams.

A steam cleaning feature may also be included in kitchen sink systems described herein. In some embodiments, a steam cleaning feature may include a plurality of nozzles in one or more side surfaces of a sink basin. When an actuating mechanism is actuated, the plurality of nozzles may dispense steam. A user may then place an item to be cleaned (e.g., a knife) into the steam for cleaning.

Further, a retractable nozzle feature may also be included in some embodiments of kitchen sink systems described herein. The retractable nozzle feature may include a base surface and one or more retractable nozzles. When activated, one or more retractable nozzles may be configured to extend upward from the base surface and dispense pressurized air and/or water. A user may place a dish to be dried or rinsed (e.g., a drinking glass) over the extended nozzle, such that the pressurized air or water comes in contact with an interior surface of the dish to dry or rinse the dish.

In some embodiments, provided is a kitchen sink system comprising: a sink basin having a first side surface and a second side surface opposite the first side surface; a first plurality of nozzles on the first side surface; a second plurality of nozzles on the second side surface; an air pump fluidly connected to the first plurality of nozzles and the second plurality of nozzles; and a first actuating mechanism, wherein when the first actuating mechanism is actuated, the air pump pumps air to the first plurality of nozzles and the second plurality of nozzles, and the first plurality of nozzles and the second plurality of nozzles dispense the air received from the air pump into the sink basin.

In some embodiments of the kitchen sink system, a colander comprising openings on a first side and a second side opposite the first side is sized to fit within the sink basin, and wherein each nozzles of the first plurality of nozzles is aligned with an opening on the first side of the colander and each nozzle of the second plurality of nozzles is aligned with an opening on the second side of the colander such that each nozzles of the first plurality of nozzles and each nozzle of the second plurality of nozzles are configured to dispense air into the colander when it is positioned within the sink basin without interference from the colander.

In some embodiments of the kitchen sink system, when the colander is positioned within the sink basin, a space between an exterior of the first side of the colander and the first side surface of the sink basin is about 1-20 mm wide, and a space between an exterior of the second side of the colander and the second side surface of the sink basin is about 1-20 mm wide.

In some embodiments of the kitchen sink system, each of the first plurality of nozzles and the second plurality of nozzles comprises about 20-50 nozzles.

In some embodiments of the kitchen sink system, the first plurality of nozzles and the second plurality of nozzles are each arranged in a diagonal grid.

In some embodiments of the kitchen sink system, the first actuating mechanism is configured to activate and deactivate the first plurality of nozzles and the second plurality of nozzles.

In some embodiments of the kitchen sink system, the first actuating mechanism is configured to activate the first plurality of nozzles and the second plurality of nozzles, and the first plurality of nozzles and the second plurality of nozzles are configured to deactivate after a predetermined amount of time.

In some embodiments of the kitchen sink system, the kitchen sink system comprises: a third plurality of nozzles along a upper portion of the first side surface; and a second actuating mechanism, wherein the third plurality of nozzles are configured to receive water from a water source and, when the second actuating mechanism is actuated, dispense the water across the sink basin such that the dispensed water contacts the second side surface of the sink basin.

In some embodiments of the kitchen sink system, the kitchen sink system comprises: fourth plurality of nozzles along a upper portion of the first side surface; and a third actuating mechanism, wherein the fourth plurality of nozzles are configured to receive steam from a steam generator and, when the third actuating mechanism is actuated, dispense the steam into the sink basin.

In some embodiments of the kitchen sink system, the kitchen sink system comprises: a base surface proximate to the sink basin, wherein a side edge of the base surface extends from a top portion of the second side surface of the sink basin; one or more retractable nozzles disposed in the base surface; and a fourth actuating mechanism, wherein when the fourth actuating mechanism is actuated, the one or more retractable nozzles are configured to extend vertically from the base surface, and when the fourth actuating mechanism is not actuated, the one or more retractable nozzles are configured to retract such that a top surface of the one or more retractable nozzles is flush with a portion of the base surface.

In some embodiments, provided is a kitchen sink system, the kitchen sink system comprising: a sink basin having a first side surface and a second side surface opposite the first side surface; a first plurality of nozzles along a upper portion of the first side surface; and a first actuating mechanism, wherein the first plurality of nozzles are configured to receive steam from a steam generator and, when the first actuating mechanism is actuated, dispense the steam into the sink basin.

In some embodiments of the kitchen sink system, the first plurality of nozzles comprises 10-30 nozzles.

In some embodiments of the kitchen sink system, the nozzles of the first plurality of nozzles are arranged horizontally in a single layer.

In some embodiments of the kitchen sink system, the first actuating mechanism is configured to activate and deactivate the first plurality of nozzles In some embodiments of the kitchen sink system, the first actuating mechanism is configured to activate the first plurality of nozzles, and the first plurality of nozzles are configured to deactivate after a predetermined amount of time.

In some embodiments of the kitchen sink system, the kitchen sink system comprises: a second plurality of nozzles on the first side surface; a third plurality of nozzles on the second side surface; an air pump fluidly connected to the second plurality of nozzles and the third plurality of nozzles; and a second actuating mechanism, wherein when the second actuating mechanism is actuated, the air pump pumps air to the second plurality of nozzles and the third plurality of nozzles, and the second plurality of nozzles and the third plurality of nozzles dispense the air received from the air pump into the sink basin.

In some embodiments of the kitchen sink system, the kitchen sink system comprises: a fourth plurality of nozzles along a upper portion of the first side surface; and a third actuating mechanism, wherein the fourth plurality of nozzles are configured to receive water from a water source and, when the third actuating mechanism is actuated, dispense the water across the sink basin such that the dispensed water contacts the second side surface of the sink basin.

In some embodiments of the kitchen sink system, the kitchen sink system comprises: a base surface proximate to the sink basin, wherein a side edge of the base surface extends from a top portion of the second side surface of the sink basin; one or more retractable nozzles disposed in the base surface; and a fourth actuating mechanism, wherein when the fourth actuating mechanism is actuated, the one or more retractable nozzles are configured to extend vertically from the base surface, and when the fourth actuating mechanism is not actuated, the one or more retractable nozzles are configured to retract such that a top surface of the one or more retractable nozzles is flush with a portion of the base surface.

In some embodiments, provided is a kitchen sink system, the kitchen sink system comprising: a sink basin having a first side surface and a second side surface opposite the first side surface; a base surface proximate to the sink basin, wherein a side edge of the base surface extends from a top portion of the second side surface of the sink basin; one or more retractable nozzles disposed in the base surface; and a first actuating mechanism, wherein when the first actuating mechanism is actuated, the one or more retractable nozzles are configured to extend upwards from the base surface, and when the first actuating mechanism is not actuated, the one or more retractable nozzles are configured to retract such that a top surface of the one or more retractable nozzles is flush with a portion of the base surface.

In some embodiments of the kitchen sink system, the fluid is air or water.

In some embodiments of the kitchen sink system, the base surface is horizontal.

In some embodiments of the kitchen sink system, the base surface is angled downward towards the sink basin.

In some embodiments of the kitchen sink system, the base surface is angled downward towards the sink basin at an angle of about 1-10 degrees.

In some embodiments of the kitchen sink system, the actuating mechanism is actuated by pushing down on the retractable nozzle.

In some embodiments of the kitchen sink system, the one or more retractable nozzles are configured to extend upwards to a first position and a second position, wherein in the second position, a height of the one or more retractable nozzles is greater than a height of the one or more retractable nozzles in the first position.

In some embodiments of the kitchen sink system, the kitchen sink system comprises: a first plurality of nozzles on the first side surface; a second plurality of nozzles on the second side surface; an air pump fluidly connected to the first plurality of nozzles and the second plurality of nozzles; and a second actuating mechanism, wherein when the second actuating mechanism is actuated, the air pump pumps air to the first plurality of nozzles and the second plurality of nozzles, and the first plurality of nozzles and the second plurality of nozzles dispense the air received from the air pump into the sink basin.

In some embodiments of the kitchen sink system, the kitchen sink system comprises: a third plurality of nozzles along a upper portion of the first side surface; and a third actuating mechanism, wherein the third plurality of nozzles are configured to receive water from a water source and, when the third actuating mechanism is actuated, dispense the water across the sink basin such that the dispensed water contacts the second side surface of the sink basin.

In some embodiments of the kitchen sink system, the kitchen sink system comprises: a fourth plurality of nozzles along a upper portion of the first side surface; and a fourth actuating mechanism, wherein the fourth plurality of nozzles are configured to receive steam from a steam generator and, when the fourth actuating mechanism is actuated, dispense the steam into the sink basin.

In some embodiments, provided is a kitchen sink system, the kitchen sink system comprising: a sink basin having a first side surface and a second side surface opposite the first side surface; a first plurality of nozzles on the first side surface; a second plurality of nozzles on the second side surface; an air pump fluidly connected to the first plurality of nozzles and the second plurality of nozzles; a first actuating mechanism, wherein when the first actuating mechanism is actuated, the air pump pumps air to the first plurality of nozzles and the second plurality of nozzles, and the first plurality of nozzles and the second plurality of nozzles dispense the air received from the air pump into the sink basin; a third plurality of nozzles along a upper portion of the first side surface; a second actuating mechanism, wherein the third plurality of nozzles are configured to receive water from a water source and, when the actuating mechanism is actuated, dispense the water across the sink basin such that the dispensed water contacts the second side surface of the sink basin; a fourth plurality of nozzles along a upper portion of the first side surface; and a third actuating mechanism, wherein the fourth plurality of nozzles are configured to receive steam from a steam generator and, when the third actuating mechanism is actuated, dispense the steam into the sink basin.

In some embodiments of the kitchen sink system, a colander comprising openings on a first side and a second side opposite the first side is sized to fit within the sink basin, and wherein each nozzles of the first plurality of nozzles is aligned with an opening on the first side of the colander and each nozzle of the second plurality of nozzles is aligned with an opening on the second side of the colander such that each nozzles of the first plurality of nozzles and each nozzle of the second plurality of nozzles are configured to dispense air into the colander when it is positioned within the sink basin without interference from the colander.

In some embodiments of the kitchen sink system, when the colander is positioned within the sink basin, a space between an exterior of the first side of the colander and the first side surface of the sink basin is about 1-20 mm wide, and a space between an exterior of the second side of the colander and the second side surface of the sink basin is about 1-20 mm wide.

In some embodiments of the kitchen sink system, each of the first plurality of nozzles and the second plurality of nozzles comprises about 20-50 nozzles.

In some embodiments of the kitchen sink system, the first plurality of nozzles and the second plurality of nozzles are each arranged in a diagonal grid.

In some embodiments of the kitchen sink system, the first actuating mechanism is configured to activate and deactivate the first plurality of nozzles and the second plurality of nozzles.

In some embodiments of the kitchen sink system, the first actuating mechanism is configured to activate the first plurality of nozzles and the second plurality of nozzles, and the first plurality of nozzles and the second plurality of nozzles are configured to deactivate after a predetermined amount of time.

In some embodiments of the kitchen sink system, the third plurality of nozzles are configured to dispense water at about a 30-90 degree angle relative to the first side surface such that the water is dispensed downward or horizontally.

In some embodiments of the kitchen sink system, the kitchen sink system comprises a fifth plurality of nozzles along an upper portion of the second side surface, the fifth plurality of nozzles configured to receive water from a water source and dispense the water across the sink basin such that the dispensed water contacts the first side surface of the sink basin.

In some embodiments of the kitchen sink system, the fifth plurality of nozzles are configured to dispense water at about a 30-90 degree angle relative to the second side surface such that the water is dispensed downward or horizontally.

In some embodiments of the kitchen sink system, the fifth plurality of nozzles comprises more nozzles than the third plurality of nozzles.

In some embodiments of the kitchen sink system, the third plurality of nozzles comprises 10-30 nozzles.

In some embodiments of the kitchen sink system, the nozzles of the third plurality of nozzles are arranged horizontally in a single layer.

In some embodiments of the kitchen sink system, the fifth plurality of nozzles comprises about 15-50 nozzles.

In some embodiments of the kitchen sink system, the nozzles of the fifth plurality of nozzles are arranged horizontally in a single layer.

In some embodiments of the kitchen sink system, the second actuating mechanism is configured to activate and deactivate the third plurality of nozzles and the fifth plurality of nozzles.

In some embodiments of the kitchen sink system, the second actuating mechanism is configured to activate the third plurality of nozzles and the fifth plurality of nozzles, and the third plurality of nozzles and the fifth plurality of nozzles are configured to deactivate after a predetermined amount of time.

In some embodiments of the kitchen sink system, the fourth plurality of nozzles comprises about 10-30 nozzles.

In some embodiments of the kitchen sink system, the nozzles of the fourth plurality of nozzles are arranged horizontally in a single layer.

In some embodiments of the kitchen sink system, the third actuating mechanism is configured to activate and deactivate the fourth plurality of nozzles.

In some embodiments of the kitchen sink system, the third actuating mechanism is configured to activate the fourth plurality of nozzles, and the fourth plurality of nozzles are configured to deactivate after a predetermined amount of time.

In some embodiments of the kitchen sink system, the kitchen sink system comprises a base surface proximate to the sink basin, wherein a side edge of the base surface extends from a top portion of the second side surface of the sink basin; one or more retractable nozzles disposed in the base surface; and a fourth actuating mechanism, wherein when the fourth actuating mechanism is actuated, the one or more retractable nozzles are configured to extend upwards from the base surface, and when the fourth actuating mechanism is not actuated, the one or more retractable nozzles are configured to retract such that a top surface of the one or more retractable nozzles is flush with a portion of the base surface.

In some embodiments of the kitchen sink system, the fluid is air or water.

In some embodiments of the kitchen sink system, the base surface is horizontal.

In some embodiments of the kitchen sink system, the base surface is angled downward towards the sink basin.

In some embodiments of the kitchen sink system, the base surface is angled downward towards the sink basin at an angle of about 1-10 degrees.

In some embodiments of the kitchen sink system, the fourth actuating mechanism is actuated by pushing down on the retractable nozzle.

In some embodiments of the kitchen sink system, the one or more retractable nozzles are configured to extend upwards to a first position and a second position, wherein in the second position, a height of the one or more retractable nozzles is greater than a height of the one or more retractable nozzles in the first position.

In some embodiments, any one or more of the features, characteristics, or elements discussed above with respect to any of the embodiments may be incorporated into any of the other embodiments mentioned above or described elsewhere herein.

DETAILED DESCRIPTION

Figure 1A:
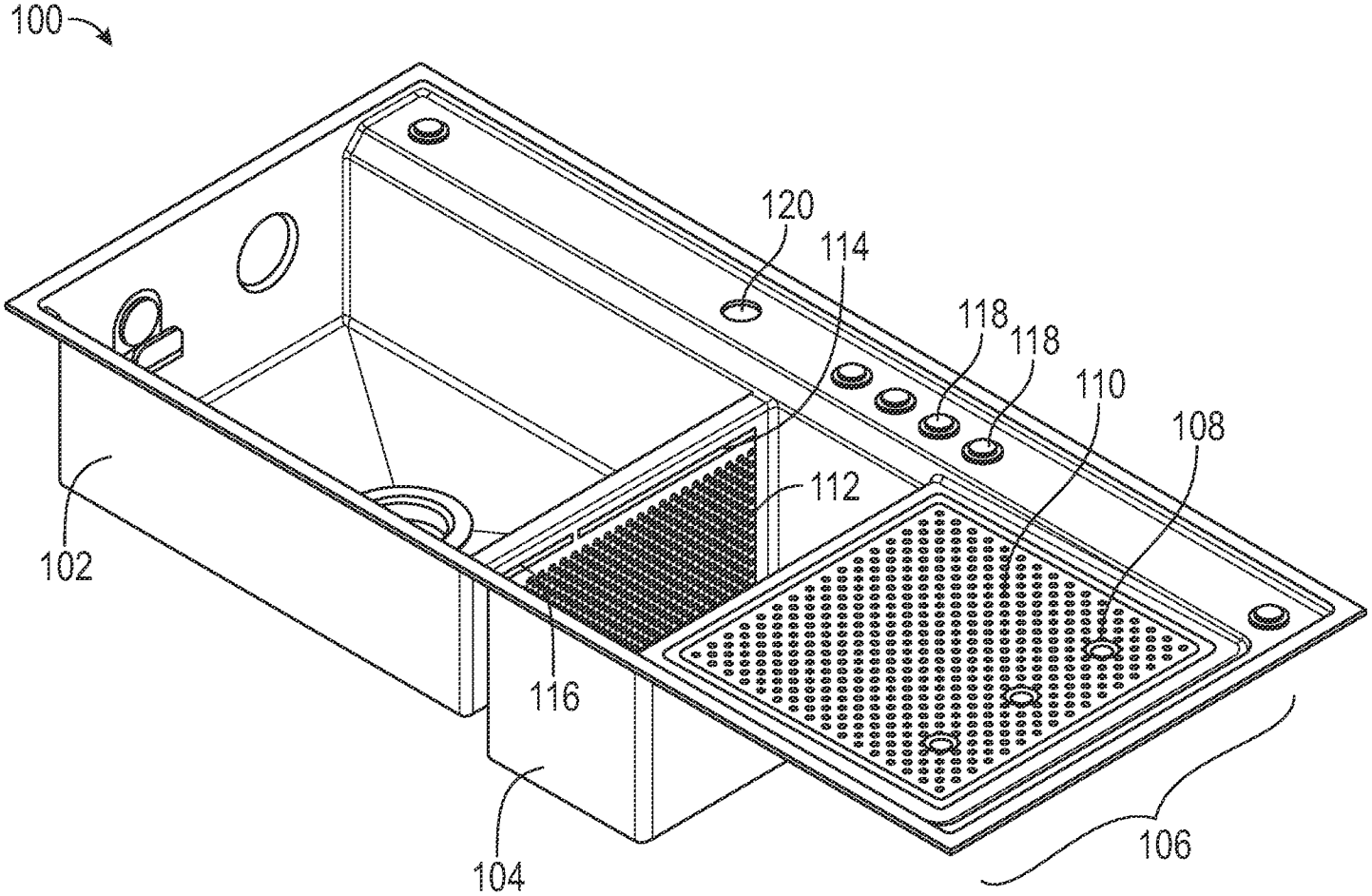
FIG. 1A shows a perspective view of a sink basin for a kitchen sink system, according to some embodiments.

Described herein are kitchen sink systems. Specifically, the kitchen sink systems described herein include one or more features that can improve a user's experience. For example, the kitchen sink systems provided herein can include one or more features related to washing, rinsing, drying, and/or cleaning. The additional feature(s) can include a microbubble feature for rinsing produce, a rinsing feature for quickly and efficiently rinsing an item (e.g., dish or user's hands), a steam cleaning feature for cleaning an item (e.g., knife), and/or a retractable nozzle feature for efficiently drying and/or rinsing an item (e.g., drinking glass). Accordingly, a user of a kitchen sink system as provided herein can experience a more efficient cooking, prepping, and/or cleaning experience due to the integration of one or more of these additional features into the kitchen sink system.

One possible feature includes a microbubble feature. An integrated microbubble feature in a kitchen sink system may be used to clean food, such as produce. The microbubble feature can include a plurality of nozzles along one or more sides of a sink basin of the kitchen sink system. When activated, the microbubble feature can dispense a number of microbubbles into the sink basin (by way of the plurality of nozzles in the one or more sides of the sink basin). In some embodiments, the sink basin may first be filled with water such that the food to be cleaned/rinsed (e.g., produce) is submerged. In some embodiments, the sink basin may be filled with water such that all nozzles are submerged. When the microbubbles (e.g., air bubbles, water bubbles) are dispensed from the nozzles and into the sink basin, the vibration caused by the microbubbles in the water can force any dirt, debris, and/or pesticides from the surface of the food.

Another feature is a rinsing feature. A rinsing feature can include a plurality of nozzles lining a top portion of one or more side surfaces of a sink basin. When activated, the plurality of nozzles can dispense water into the sink basin. The plurality of nozzles can be positioned such that they dispense water horizontally across to an opposing side surface of the sink basin. The plurality of nozzles may also be positioned such that they dispense water at a downward angle across to an opposing side surface of the sink basin. In some embodiments, the plurality of nozzles comprises a number of nozzles consecutively installed in a straight line such that when the rinsing feature is activated, a curtain of water (formed by a plurality of water streams, each stream being dispensed from a nozzle of the plurality of nozzles) is dispensed across the sink basin. A user can place an item to be rinsed (e.g., user's hands, a dish such as a plate) into the curtain of water streams.

Another optional feature that may be integrated into a kitchen sink system provided herein is a steam cleaning feature. A steam cleaning feature may be used to clean an item such as a knife. The steam cleaning feature can include a plurality of nozzles along a top portion of a side surface of a sink basin. The nozzles may be configured to eject steam that can be used to clean an item.

Additionally, kitchen sink systems described herein can include a retractable nozzle feature for rapidly drying items (e.g., dishes) and/or for rapidly rinsing items (e.g., drinking glass). The retractable nozzle feature can include a base surface or tray located proximate to the sink basin. In some embodiments, the base or tray can be counter height. From the tray, one or more retractable nozzles can be configured to extend from the tray when the drying feature is activated, and retract below a surface of the base when the drying feature is deactivated. When the retractable nozzle feature is activated and a nozzle is extended, a user can place an item to be dried (e.g., dish, drinking glass) over the nozzle. The nozzle may be configured to eject a fluid such as pressurized air and/or water. The pressurized air can come in contact with a surface of the area of the item that is placed proximate to the nozzle, forcing any water or debris from the surface of the item.

Referring now to the drawings, like parts are marked throughout the specification and drawings with the similar reference numerals, respectively.

Figure 1B:
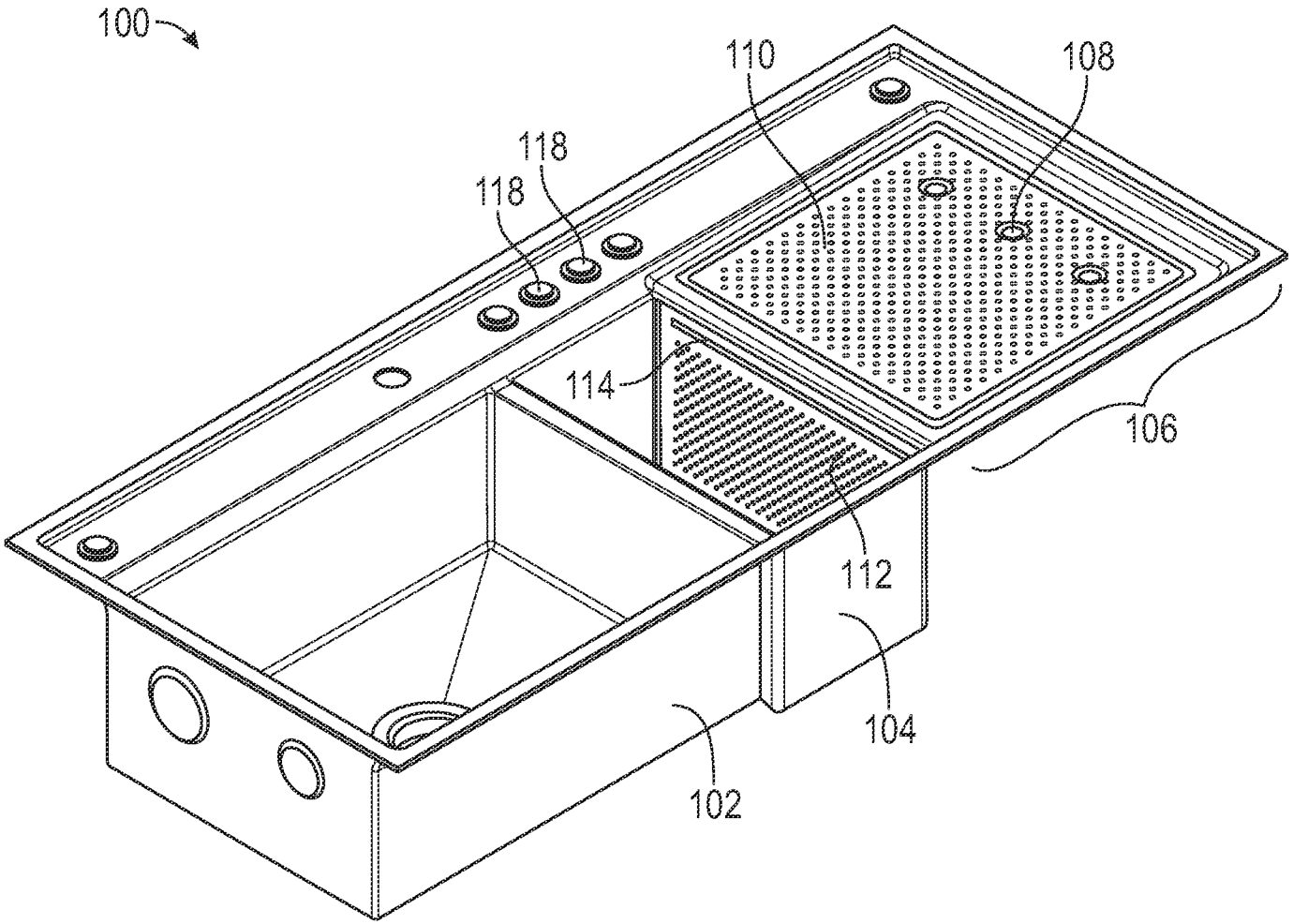
FIG. 1B shows a perspective view of a sink basin for a kitchen sink system, according to some embodiments.
Figure 1C:
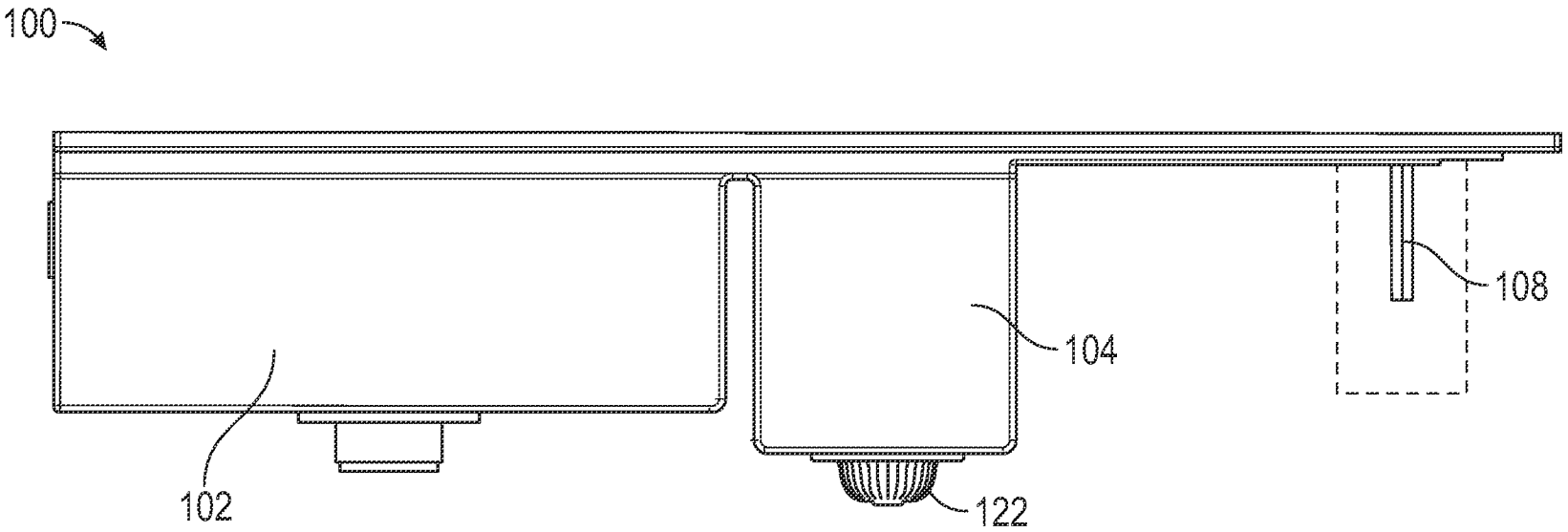
FIG. 1C shows a front view of a kitchen sink system, according to some embodiments.
Figure 1D:
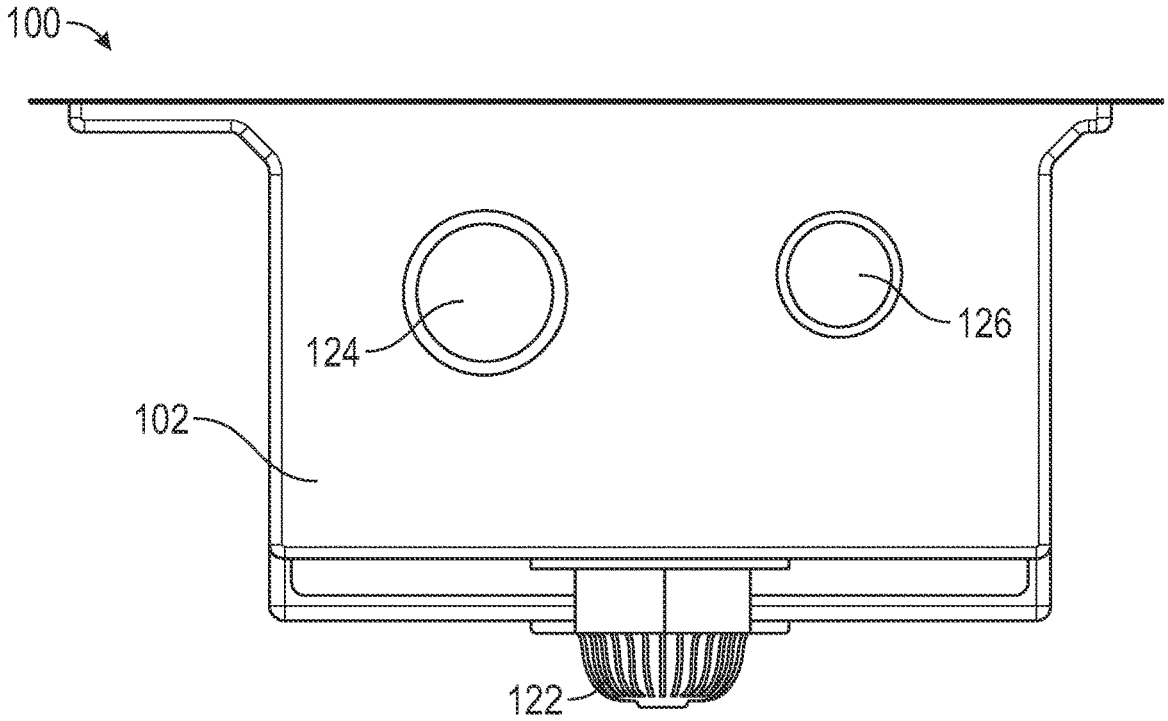
FIG. 1D shows a side view of a kitchen sink system, according to some embodiments.
Figure 1E:
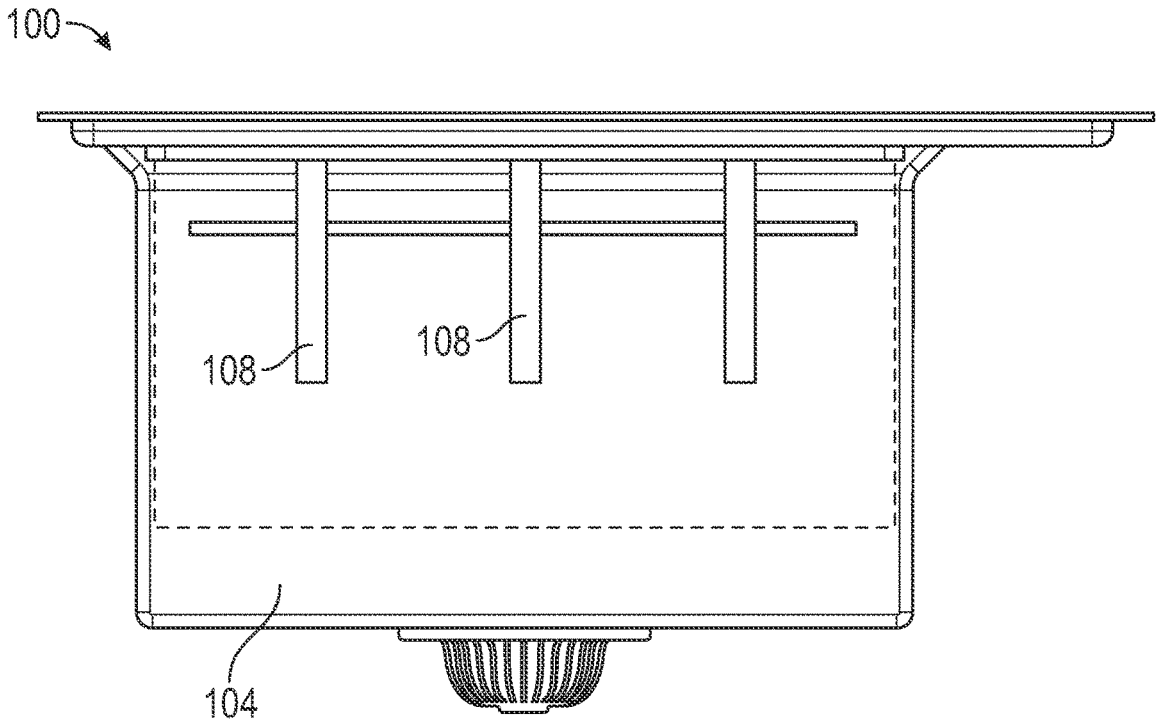
FIG. 1E shows a side view of a kitchen sink system, according to some embodiments.
Figure 1F:
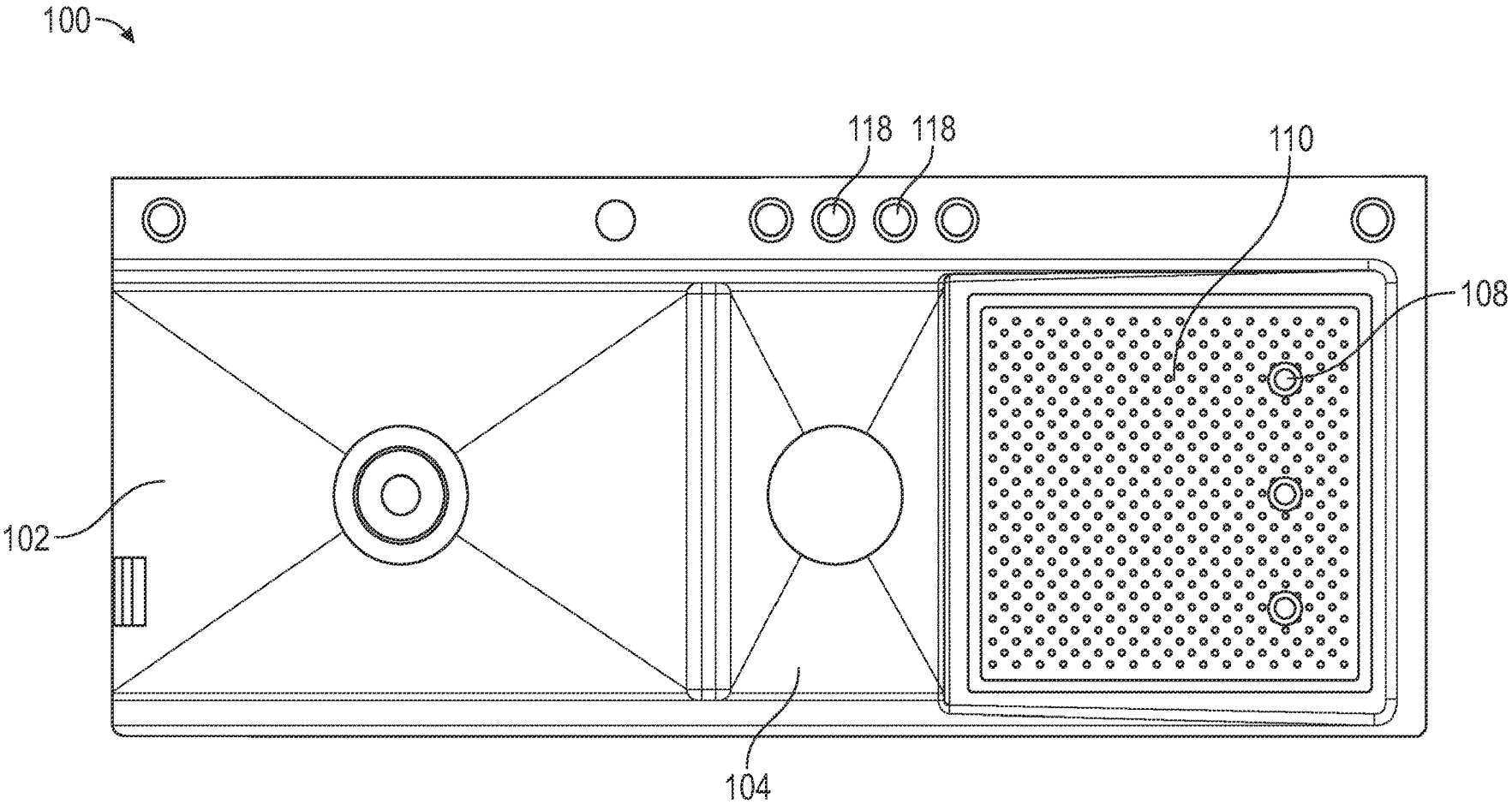
FIG. 1F shows a top view of a kitchen sink system, according to some embodiments.

FIGS. 1A and 1B show perspective views of a kitchen sink system 100 according to some embodiments. FIG. 1C shows a front view of a kitchen sink system 100, FIG. 1D shows a first side view of a kitchen sink system 100, FIG. 1E shows a second side view of kitchen sink system 100, and FIG. 1F shows a top view of a kitchen sink system 100, according to some embodiments. As shown in the various figures, kitchen sink system 100 can include two sink basins, sink basin 102 and sink basin 104, a plurality of actuating mechanisms 118, rinsing/drying feature 106 comprising one or more retractable nozzles 108 and tray 110, a plurality of rinsing nozzles 114, a plurality of steaming nozzles 116, and a plurality of air nozzles 112. A faucet for kitchen sink system 100 may be configured to mount at opening 120.

Kitchen sink system 100 is shown comprising all four of the additional features (i.e., microbubble feature, rinsing feature, steam cleaning feature, and retractable nozzle feature). However, a kitchen sink system according to embodiments described herein can include any one, two, or three features described.

In some embodiments, kitchen sink system 100 may include two different sink basins, sink basin 102 and sink basin 104, as shown in the figures. One sink basin (e.g., sink basin 102) may be the main sink basin. The main sink basin may only be provided with a sink drain 122. The main sink basin may be configured to receive water from a water faucet, and empty the water through sink drain 122.

In some embodiments, kitchen sink system 100 may include an accessory sink basin (e.g., sink basin 104). Accessory sink basin 104 includes a first side surface and a second side surface opposite the first side surface. Accessory sink basin may be provided with one or more of the multiple additional features described herein. By providing these multiple features in an accessory sink basin separate from the main sink basin, the additional features will not interfere or get in the way of the main sink basin that can be used for prepping, washing, and/or cleaning. In some embodiments, kitchen sink system 100 may include only a single sink basin.

One additional feature can include a rinsing feature. As shown in the figures, rinsing feature can include a plurality of rinsing nozzles 114 in a side surface of sink basin 104. In some embodiments, the rinsing nozzles 114 may be located in a first side surface and in a second side surface of sink basin 104. In some embodiments, the rinsing nozzles 114 are arranged in an upper portion of the first side surface and/or the second side surface of sink basin 104. Rinsing nozzles 114 may be arranged horizontally along the upper portion of a side surface of sink basin 104, as shown in the figures. In some embodiments, rinsing nozzles 114 are arranged in a single layer. In some embodiments, rinsing nozzles 114 are arranged in two, three, four, or more layers. Rinsing nozzles 114 may be positioned such that they dispense a stream of water across sink basin 104 that comes in contact with the opposing side surface. For example, rinsing nozzles 114 arranged on a first side surface of sink basin 104 may be configured to dispense a stream of water across sink basin 104 such that the water contacts a second side surface of sink basin 104. The side surfaces of sink basin 104 should not be limited to a left and/or right side surface of sink basin 104; the side surfaces may also be interpreted as a front and/or rear surface of sink basin 104.

In some embodiments, rinsing nozzles 114 may be configured to dispense water in a direction that is perpendicular to the surface from which the rinsing nozzles 114 are arranged. In such an embodiment, the rinsing nozzles 114 may be configured to dispense water in a direction that is parallel to a bottom surface of sink basin 104 (or perpendicular to a side surface of sick basin 104 from which rinsing nozzles 114 extend). In some embodiments, rinsing nozzles 114 may be positioned such that they dispense water at a downward angle. In such an embodiment, the water stream dispensed from rinsing nozzles 114 may be configured to directly contact the opposing side surface of sink basin 104. In some embodiments, the water stream dispensed from rinsing nozzles 114 may be configured to directly contact the bottom surface of sink basin 104. An angle at which a water stream is dispensed from a rinsing nozzle 114 may be from about 20-90, about 30-90, about 30-89, about 40-89, or about 50-89 degrees relative to the side surface of sink basin 104, wherein a water stream dispensed at 90 degrees is dispensed perpendicular relative to the side surface of sink basin 104. In some embodiments, the dispensing angle may be less than or equal to about 90, about 89, about 85, about 80, about 75, about 70, about 60, about 50, about 40, or about 30 degrees relative to the side surface of sink basin 104. In some embodiments, the dispensing angle may be greater than or equal to about 20, about 30, about 40, about 50, about 60, about 70, about 75, about 80, or about 85 degrees relative to the side surface of sink basin 104.

In some embodiments, the arrangement of rinsing nozzles 114 can form a "curtain" of dispensed water. The "curtain" of water can include a plurality of water streams in close proximity to each other. In some embodiments, when rinsing nozzles 114 are located on two opposing side surfaces of sink basin 104, the "curtain" of water formed from a first plurality of rinsing nozzles 114 on a first side surface and the "curtain" of water formed from a second plurality of rinsing nozzles 114 on a second side surface intersect.

In some embodiments, as explained above, rising nozzles 114 may be located along two opposing side surfaces of sink basin 104. In some embodiments, a first plurality of rinsing nozzles 114 may be located on a first side surface of sink basin 104, and a second plurality of rinsing nozzles 114 may be located on a second side surface of sink basin 104. In some embodiments, the number of rinsing nozzles 114 of the first plurality of rinsing nozzles 114 may be greater than the number of rinsing nozzles 114 of the second plurality of rinsing nozzles 114. In some embodiments, the number of rinsing nozzles 114 of the first plurality of rinsing nozzles 114 may be greater than the number of rinsing nozzles 114 of the second plurality of rinsing nozzles 114. In some embodiments, the number of rinsing nozzles 114 of the first plurality of rinsing nozzles 114 may be less than the number of rinsing nozzles 114 of the second plurality of rinsing nozzles 114. In some embodiments, the first plurality of rinsing nozzles 114 may comprise about 5-50 or about 10-30 rinsing nozzles. In some embodiments, the first plurality of rinsing nozzles 114 may comprise less than or equal to about 50, about 40, about 30, about 20, or about 10 nozzles. In some embodiments, the first plurality of rinsing nozzles 114 may comprise more than or equal to about 5, about 10, about 20, about 30, or about 40 nozzles. In some embodiments, the second plurality of rinsing nozzles 114 may comprise about 5-60, about 15-50, or about 20-40 rinsing nozzles. In some embodiments, the second plurality of rinsing nozzles 114 may comprise less than or equal to about 60, about 50, about 40, about 30, about 20, about 15, or about 10 rinsing nozzles. In some embodiments, the second plurality of rinsing nozzles 114 may comprise more than or equal to about 5, about 10, about 15, about 20, about 30, about 40, or about 50 rinsing nozzles. The number of rinsing nozzles 114 is directly related to the size of the water stream "curtain" that is formed. More rinsing nozzles 114 directly translates to a larger (e.g., longer, wider, taller, more dense) curtain, depending on the arrangement of the nozzles. Conversely, fewer rinsing nozzles 114 directly translates to a smaller (e.g., shorter, narrower, less dense) curtain, depending on the arrangement of the rinsing nozzles.

The placement of the rinsing nozzles 114 relative to each other can impact the effectiveness of the rinsing feature. For example, if the rinsing nozzles 114 are placed too far apart from each other, the rinsing feature would not be particularly effective, since a user would have to manipulate (i.e., move around) the item to be rinsed to make sure water contacts all areas of the item (or the areas to be rinsed). However, if the rinsing nozzles 114 are placed in relatively close proximity to each other, the rinsing feature may be more able to more effectively rinse an item placed in the water curtain generated by the rinsing feature. In some embodiments, the distance between two rinsing nozzles 114 may be about 1-20, about 1-10, or about 1-5 mm. In some embodiments, the distance between two rinsing nozzles 114 may be less than or equal to about 20, about 18, about 15, about 12, about 10, about 8, about 5, about 3, or about 2 mm. In some embodiments, the distance between two rinsing nozzles 114 may be greater than or equal to about 1, about 2, about 3, about 5, about 8, about 10, about 12, about 15, or about 18 mm.

As shown in the figures, kitchen sink system 100 can comprise a plurality of actuating mechanisms 118, at least one of which may be configured to control the operation of the rinsing feature (i.e., the plurality of rinsing nozzles 114). When selected, actuating mechanism 118 can turn on the plurality of rinsing nozzles 114 such that they dispense water in sink basin 104. In some embodiments, a user must select actuating mechanism 118 a second time to turn the water flow from the plurality of nozzles 114 off. In some embodiments, the water flow from the plurality of rinsing nozzles 114 may automatically turn off after a predetermined amount of time. In some embodiments, a user must continuously select actuating mechanism 118 (e.g., maintain in a continuous "on" position) for water to flow from the plurality of rinsing nozzles 114, and once actuating mechanism 118 is no longer selected, water flow from the plurality of nozzles 114 stops.

Another feature included in kitchen sink system 100 may be a microbubble feature. The microbubble feature can dispense a plurality of microbubbles from a plurality of air nozzles 112 into the sink basin 104. When the microbubbles (i.e., air bubbles) are dispensed into a sink basin filled with water, the air bubbles can vibrate in the water. The vibration and friction caused by the air bubbles in the water can force dirt or pesticides from the surface of produce or other food submerged in the water. Thus, the microbubble feature can provide a method of cleaning and rinsing produce and other food without the use of detergents or other soaps.

The plurality of air nozzles 112 are fluidly connected to an air pump. The air pump is positioned below deck, and provides air to the air nozzles 112 which are configured to dispense air bubbles into the sink basin 104.

As shown in the figures, the microbubble feature comprises a plurality of air nozzles 112. In some embodiments, the plurality of air nozzles 112 may be located on a single interior side surface of the sink basin 104. In some embodiments, the plurality of air nozzles 112 may be located on two interior side surfaces of the sink basin 104, a first side surface opposite the second side surface. In some embodiments, the air nozzles 112 are configured to dispense air in a direction that is perpendicular to the side surface of sink basin 104.

In some embodiments, the plurality of air nozzles 112 may be arranged in a grid. In some embodiments, the plurality of air nozzles 112 may be arranged in a diagonal grid. In some embodiments, the number of air nozzles 112 on a single side surface may comprise 5-100 air nozzles or 10-50 air nozzles. In some embodiments, the number of air nozzles 112 on a single side surface may comprise less than or equal to about 100, about 90, about 80, about 70, about 60, about 50, about 40, about 30, about 20, or about 10 air nozzles. In some embodiments, the number of air nozzles 112 on a single side surface may comprise more than or equal to about 5, about 10, about 20, about 30, about 40, about 50, about 60, about 70, about 80, or about 90 nozzles. More air nozzles 112 can achieve a greater vibration effect, which can more efficiently and effectively remove dirt, pesticides, and debris from the surface of produce. Fewer air nozzles may be able to better align with the openings of a colander when placed into sink basin 104, as explained below.

The placement of the air nozzles 112 relative to each other can impact the effectiveness of the microbubble feature. For example, if the air nozzles 112 are placed too far apart from each other, the microbubble feature would not be particularly effective, since the vibration effect generated by the microbubbles in the water becomes stronger (and more effective at removing dirt, pesticides, and debris from the surface of produce) as the density of microbubbles in the water increases. However, if the air nozzles 112 are placed in relatively close proximity to each other, the microbubble feature may be more able to more effectively remove dirt, pesticides, and debris from the surface of produce. In some embodiments, the distance between two air nozzles 112 may be about 1-20, about 1-10, or about 1-5 mm. In some embodiments, the distance between two air nozzles 112 may be less than or equal to about 20, about 18, about 15, about 12, about 10, about 8, about 5, about 3, or about 2 mm. In some embodiments, the distance between two air nozzles 112 may be greater than or equal to about 1, about 2, about 3, about 5, about 8, about 10, about 12, about 15, or about 18 mm.

In some embodiments, the microbubble feature may be configured to operate with a colander. Using a colander can permit easy placement and removal of produce from the sink basin 104. Specifically, the produce can be placed into the colander, and all the produce can be placed in to the sink basin 104 by a single motion of placing the colander into the sink basin 104. The produce can then be easily removed from the sink basin 104 by the single motion of removing the colander from the sink basin 104. This is more efficient than placing each piece of produce into the sink basin 104 one by one.

The colander can include a plurality of openings on at least two opposing side surfaces. The colander should comprise openings on at least the surface(s) that face the side surface(s) of the sink basin 104 that include air nozzles 112. In some embodiments, each air nozzle 112 aligns with an opening of the colander, such that the air nozzle 112 can dispense air into the colander without interference from the side surface of the colander. In some embodiments, the colander is configured to fit complementarily in the sink basin 104, such that each side wall of the colander is proximate to a side surface of the sink basin 104. In some embodiments, a space between an exterior of a side wall or side surface of the colander and the proximate side surface of the sink basin 104 is about 1-20 or about 3-10 mm wide. In some embodiments, the space between an exterior of a side wall or side surface of the colander and the proximate side surface of the sink basin 104 is less than or equal to about 20, about 18, about 15, about 12, about 10, about 8, about 5, or about 3 mm wide. In some embodiments, the space between an exterior of a side wall or side surface of the colander and the proximate side surface of the sink basin 104 is greater than or equal to about 1, about 3, about 5, about 8, about 10, about 12, about 15, or about 18 mm wide.

As explained, the microbubble feature works most effectively when the sink is full of water. In some embodiments, the actuating mechanism 118 configured to control the operation of air nozzles 112 may prevent operation of the air nozzles 112 in the event the water level in the sink basin 104 is not high enough. For example, the water level of the sink basin 104 may be high enough such that all air nozzles 112 are submerged in water.

As shown in the figures, kitchen sink system 100 can comprise a plurality of actuating mechanisms 118, at least one of which may be configured to control the operation of the microbubble feature (i.e., the plurality of air nozzles 112). When selected, actuating mechanism 118 can turn on the plurality of air nozzles 112 such that they dispense water in sink basin 104. In some embodiments, a user must select actuating mechanism 118 a second time to turn the air flow from the plurality of air nozzles 112 off. In some embodiments, the air flow from the plurality of air nozzles 112 may automatically turn off after a predetermined amount of time. In some embodiments, a user must continuously select actuating mechanism 118 (e.g., maintain in a continuous "on" position) for air to flow from the plurality of air nozzles 112, and once actuating mechanism 118 is no longer selected, air flow from the plurality of air nozzles 112 stops.

A further additional feature of kitchen sink system 100 can include a steam cleaning feature. A steam cleaning feature can dispense steam from a plurality of steam nozzles 116 into an interior space of the sink basin. The steam may be used to clean an item such as a stainless steel knife without the use of detergents or other soaps.

The plurality of steam nozzles 116 may be in fluid communication with a steam generator. The steam generator may be located below deck, and may be operated by one of actuating mechanisms 118. The steam generator may receive water from a water source, and heat the water to generate steam. The generated steam may then be delivered to the steam nozzles 116 to dispense into the sink basin 104.

In some embodiments, the plurality of steam nozzles 116 are located on a single side surface of sink basin 104. In some embodiments, the plurality of steam nozzles 116 are located on two opposing sides of sink basin 104. In some embodiments, the plurality of steam nozzles 116 are located along a top portion of a side surface of sink basin 104. In some embodiments, the plurality of steam nozzles 116 may be arranged horizontally along the upper portion of a side surface of sink basin 104, as shown in the figures. In some embodiments, steam nozzles 116 are arranged in a single layer. In some embodiments, steam nozzles 116 are arranged in two, three, four, or more layers. The steam nozzles 116 may be configured to dispense steam in a direction that is perpendicular to the side surface of sink basin 104.

In some embodiments, the total number of steam nozzles 116 and the spacing/arrangement of the nozzles 116 can impact the effectiveness of the steam cleaning feature. For example, a greater number of nozzles 116 can produce more steam, which may be able to more effectively clean an item. Further, nozzles 116 that are placed more closely together can generate a more dense steam cloud, which can also more effectively clean an item. In some embodiments, the plurality of steam nozzles 116 can include 5-50 steam nozzles 116 in a single side of the sink basin 104. In some embodiments, the plurality of steam nozzles 116 can include less than or equal to about 50, about 45, about 40, about 35, about 30, about 25, about 20, about 15, or about 10 steam nozzles 116. In some embodiments, the plurality of steam nozzles 116 can include greater than or equal to about 5, about 10, about 15, about 20, about 25, about 30, about 35, about 40, or about 45 steam nozzles 116. In some embodiments, the distance between two steam nozzles 116 may be about 1-20, about 1-10, or about 1-5 mm. In some embodiments, the distance between two steam nozzles 116 may be less than or equal to about 20, about 18, about 15, about 12, about 10, about 8, about 5, about 3, or about 2 mm. In some embodiments, the distance between two steam nozzles 116 may be greater than or equal to 1, about 2, about 3, about 5, about 8, about 10, about 12, about 15, or about 18 mm.

As shown in the figures, kitchen sink system 100 can comprise a plurality of actuating mechanisms 118, at least one of which may be configured to control the operation of the steam cleaning feature (i.e., the plurality of steam nozzles 116). When selected, actuating mechanism 118 can turn on the plurality of steam nozzles 116 such that they dispense air in sink basin 104. In some embodiments, a user must select actuating mechanism 118 a second time to turn the steam flow from the plurality of steam nozzles 116 off. In some embodiments, the steam flow from the plurality of steam nozzles 116 may automatically turn off after a predetermined amount of time. In some embodiments, a user must continuously select actuating mechanism 118 (e.g., maintain in a continuous "on" position) for steam to flow from the plurality of steam nozzles 116, and once actuating mechanism 118 is no longer selected, steam flow from the plurality of steam nozzles 116 stops.

Kitchen sink system 100 can also include a retractable nozzle feature 106 according to some embodiments provided herein. As shown in the figures, retractable nozzle feature 106 can include at least one retractable nozzle 108 and a tray 110. The at least one retractable nozzle 108 is configured to extend in an upward direction from the surface of tray 110 when actuated by an actuating mechanism 118.

The retractable nozzle feature 106 can be configured to dry an item (e.g., dish, drinking glass) using pressurized air, or clean an item (e.g., dish, drinking glass) using a water spray. In the case of a retractable nozzle feature 106 that dries, the need for a user to manually dry the item with a hand towel may be eliminated, for example. In the case of a retractable nozzle feature 106 that rinses, the need for a used to manipulate the item in a stream of water from a sink faucet is eliminated, for example, since the user just has to place the item over the nozzle. Retractable nozzle 108 is configured to dispense pressurized air and/or water such that, when a dish or drinking glass, for example, is placed over the retractable nozzle 108, the pressurized air and/or water can come in contact with a surface of the dish or drinking glass, forcing water or debris off the surface of the dish or drinking glass. In some embodiments, a retractable nozzle feature 106 can include two or more retractable nozzles 108 in which both dispense water, both dispense air, one dispenses water an one dispenses air, or both dispense water and air at different times depending on user needs.

In some embodiments, tray or base surface 110 may be horizontal. In some embodiments, tray 110 may be inclined slightly downward towards sink basin 104 to allow any water to drain into sink basin 104. For example, tray 110 may be positioned at an angle of about 1-30, or about 5-20 degrees. In some embodiments, tray 110 may be positioned at an angle less than or equal to about 30, about 25, about 20, about 15, about 10, or about 5 degrees. In some embodiments, tray 110 may be positioned at an angle that is greater than or equal to about 1, about 5, about 10, about 15, about 20, or about 25 degrees. In some embodiments, tray 110 can include a plurality of openings, which can allow water to drain from the surface of tray 110.

Retractable nozzle feature 106 can include one or more retractable nozzles 108. With more retractable nozzles 108, more items (e.g., dishes, glasses) can be dried or rinsed at the same time. For example, with a retractable nozzle feature 106 comprising three retractable nozzles, a user can place an item over each of the three retractable nozzles 108, such that three items are dried or rinsed simultaneously. In some embodiments, retractable nozzle feature 106 can comprise about 1-20, about 2-10, or about 2-5 retractable nozzles 108. In some embodiments, retractable nozzle feature can include less than or equal to about 20, about 18, about 16, about 14, about 12, about 10, about 8, about 6, about 4, or about 2 retractable nozzles 108. In some embodiments, retractable nozzle feature can include more than or equal to about 1, about 2, about 4, about 6, about 8, about 10, about 12, about 14, about 16, or about 18 retractable nozzles.

Retractable nozzle 108 may be, when actuated by an actuating mechanism 118, configured to extend upwards from the surface of tray 110. In some embodiments, retractable nozzle 108 may be configured to extend upwards to a first position and a second position. In a first position, the height of retractable nozzle 108 may be lower than the height of retractable nozzle 108 in a second position. In some embodiments, a first retractable nozzle 108 may be configured to extend upwards to a first height, and a second retractable nozzle 108 may be configured to extend upwards to a second height, wherein the second height is greater than the first height.

Retractable nozzle 108 may be in fluid communication with a pressurized air source located below deck in the case of a drying feature 106. Retractable nozzle 108 may be in fluid communication with a water source located below deck in the case of retractable nozzle rinsing feature 106.

Figure 2:
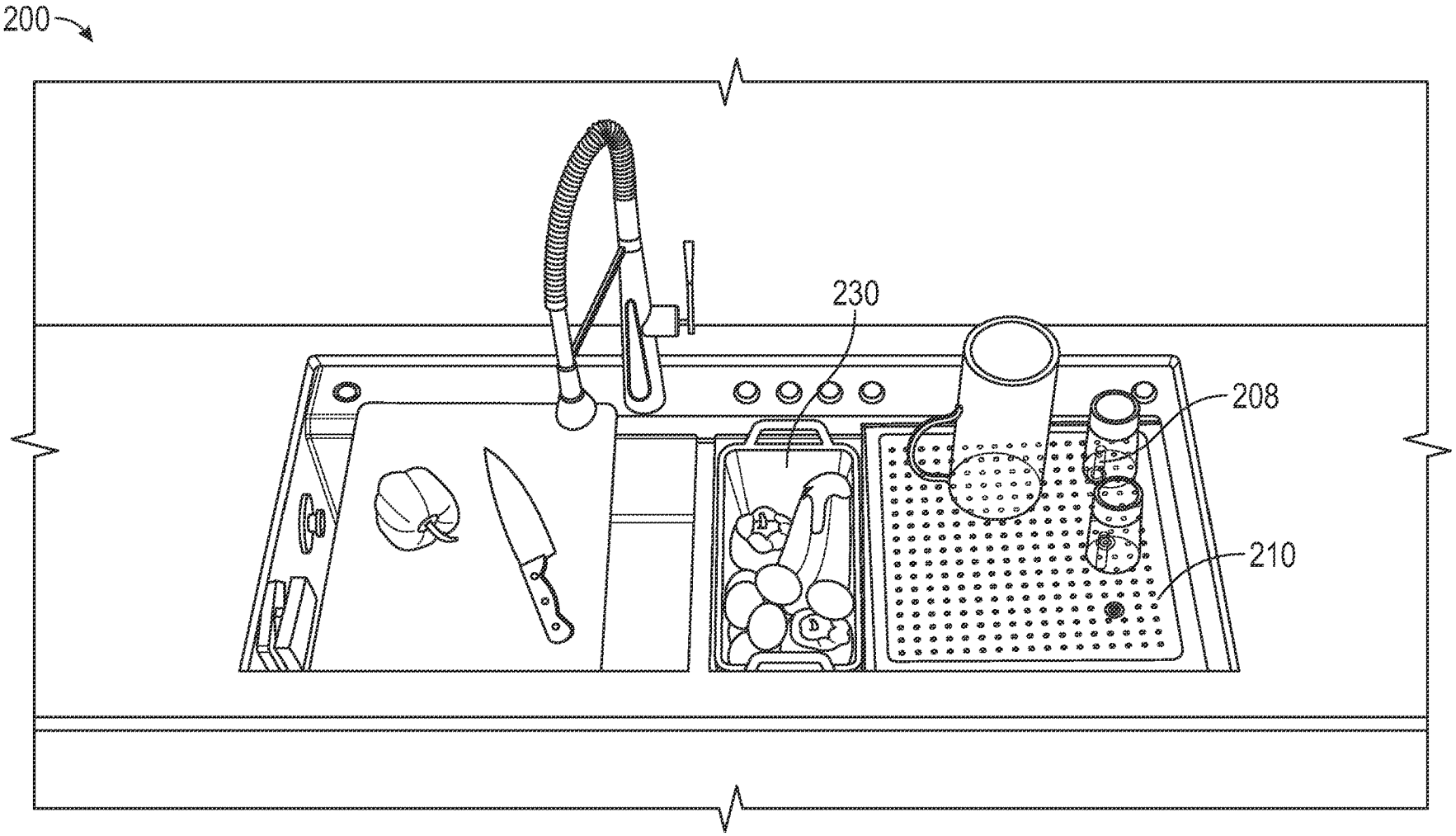
FIG. 2 shows a perspective view of a kitchen sink system, according to some embodiments.

FIG. 2 shows a perspective view of a kitchen sink system 200 according to some embodiments. As shown, kitchen sink system 200 can include an accessory sink basin and a retractable nozzle feature comprising tray 210 and at least one retractable nozzle 208. Colander 230 is shown placed in the accessory sink basin. Specifically, colander 230 is complementarily sized and shaped to fit snugly into the sink basin.

Figure 3:
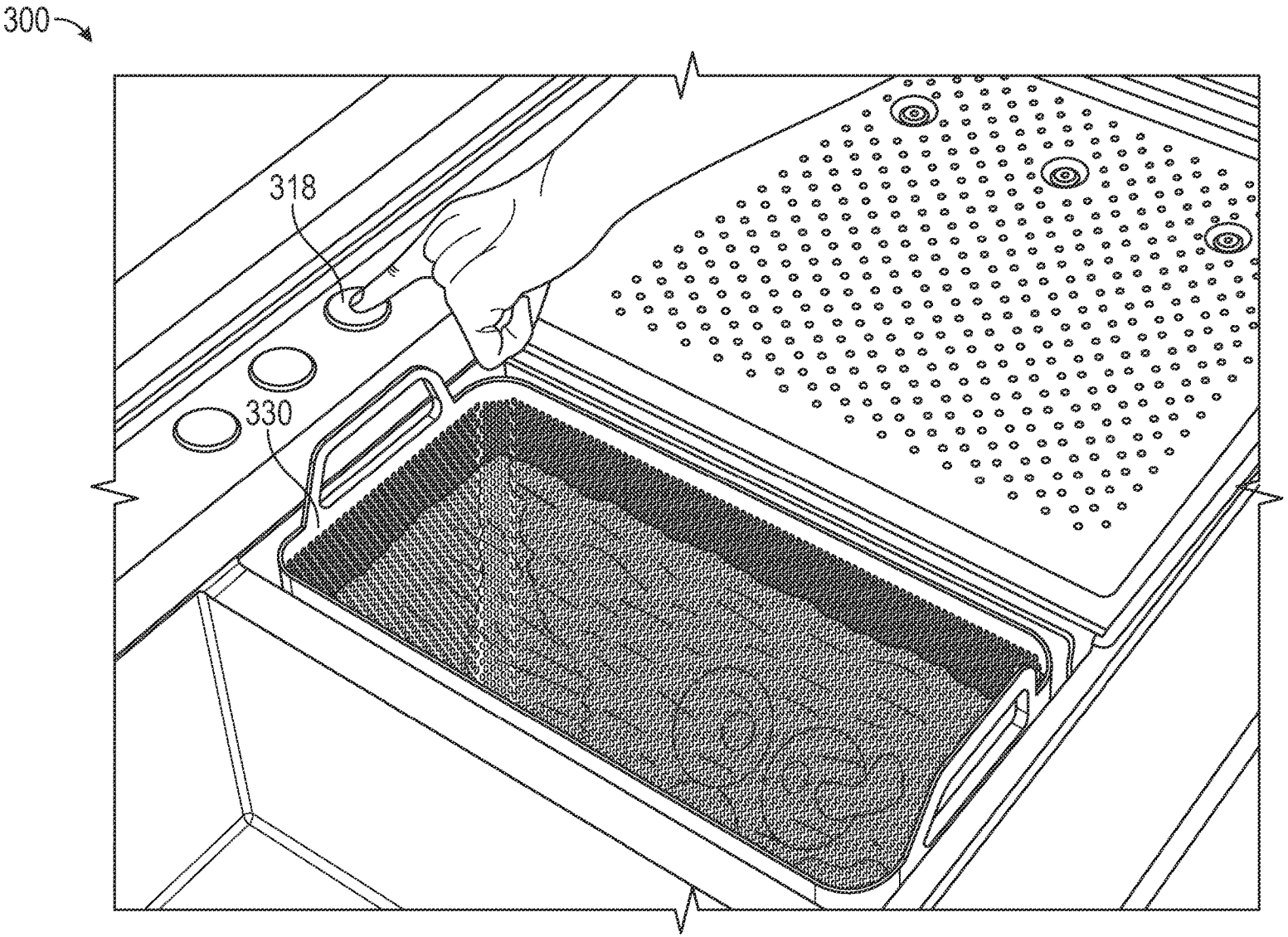
FIG. 3 shows a microbubble feature of a kitchen sink system, according to some embodiments.

FIG. 3 shows a microbubble feature of a kitchen sink system 300, according to some embodiments. Specifically, FIG. 3 shows a user operating the microbubble feature by selecting actuating mechanism 318. As shown, selecting actuating mechanism 318 causes the flow of air bubbles from the plurality of air nozzles in a side surface of the sink basin. The air bubbles flow into the water of the sink basin, creating a vibration effect. The vibration effect can cause the removal of dirt, pesticides, and debris from the surface of the produce. Additionally, like colander 230 of FIG. 2, the colander 330 of FIG. 3 is shown fitting complementarily into the sink basin.

Figure 4:
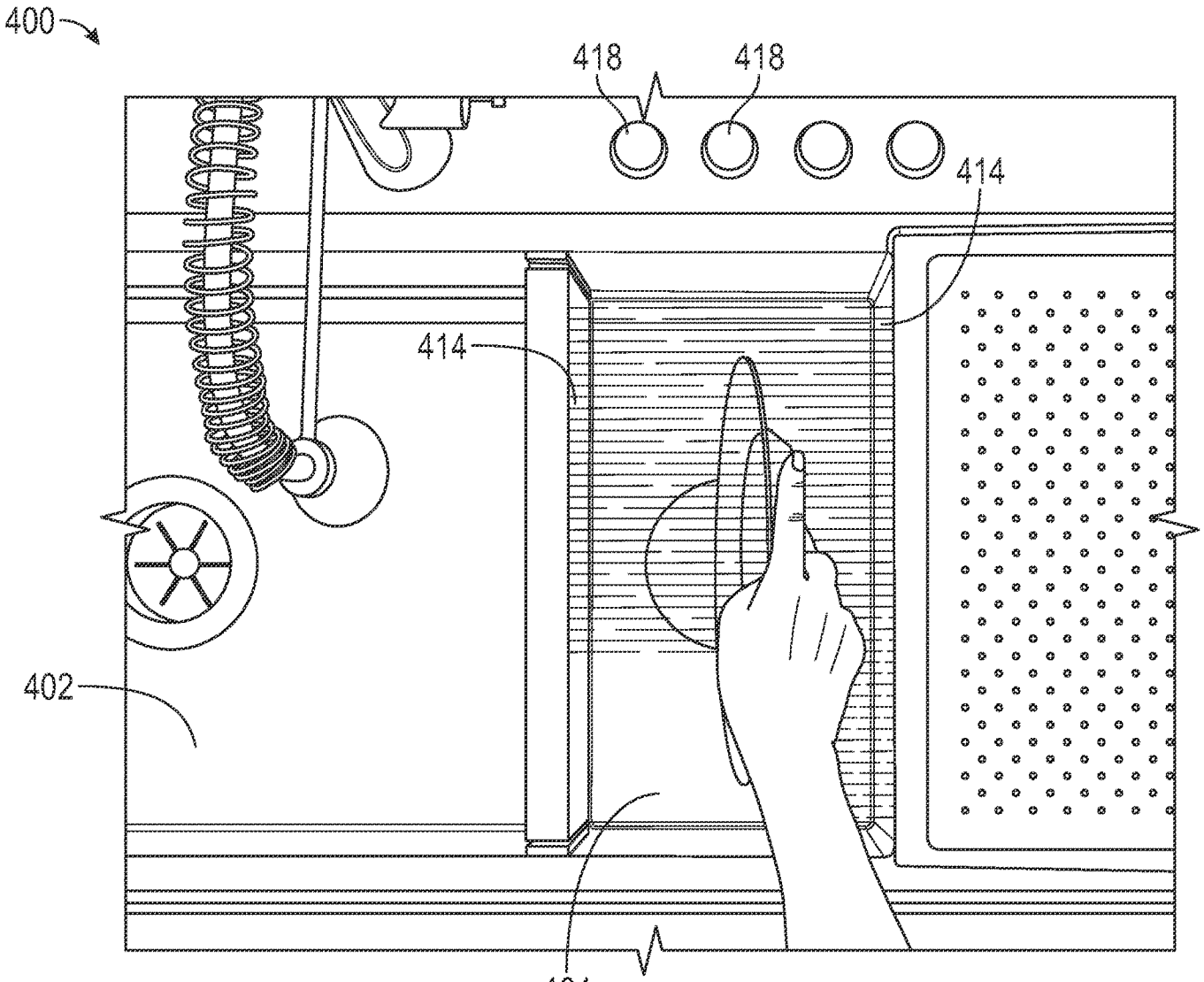
FIG. 4 shows a rinsing feature of a kitchen sink system, according to some embodiments.

FIG. 4 shows a top view of a rinsing feature of a kitchen sink system 400, according to some embodiments. As shown, kitchen sink system 400 with a rinsing feature can include a main sink basin 402 and an accessory sink basin 404 in which the rinsing feature is located. Specifically, the rinsing feature can include a plurality of rinsing nozzles 414 in sink basin 404. To operate the plurality of rinsing nozzles 414, a user may select an actuating mechanism 418 to cause water to flow from the plurality of rinsing nozzles 414. As shown, a user may place an item to be rinsed (e.g., a plate) into the curtain of water formed by the plurality of rinsing nozzles 414 to rinse the item.

Figure 5:
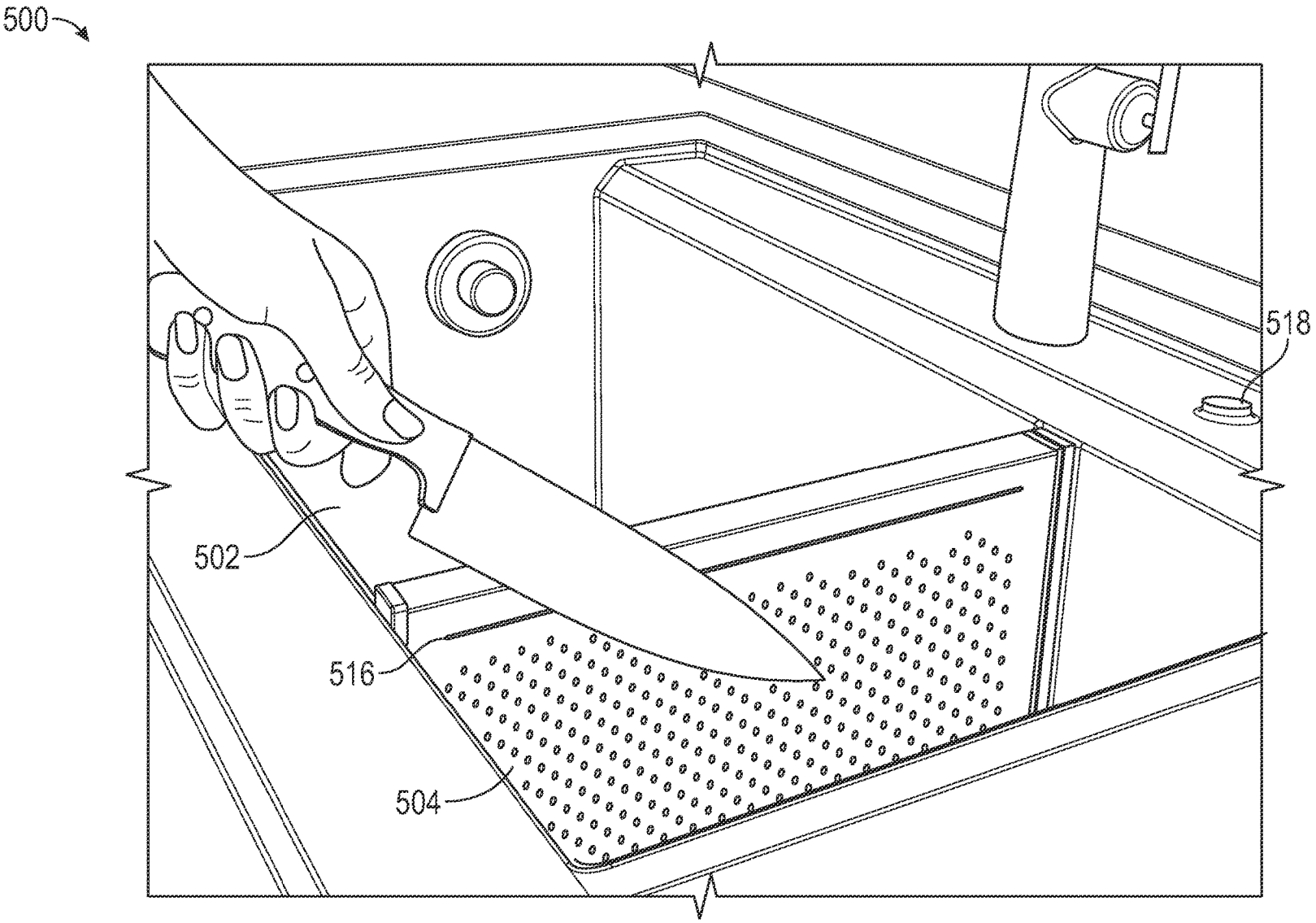
FIG. 5 shows a steam cleaning feature of a kitchen sink system, according to some embodiments.

FIG. 5 shows a steam cleaning feature of a kitchen sink system 500, according to some embodiments. As shown, kitchen sink system 500 can include a main sink basin 502 and an accessory sink basin 504 comprising the steam cleaning feature. Sink basin 504 can include a plurality of steam nozzles 516 in a side surface of sink basin 504. When a user actuates the actuating mechanism 518, steam is caused to be dispensed from the plurality of steam nozzles 516. A user can then place an item to be cleaned (e.g., a knife) into the dispensed steam to clean the item.

Figure 6:
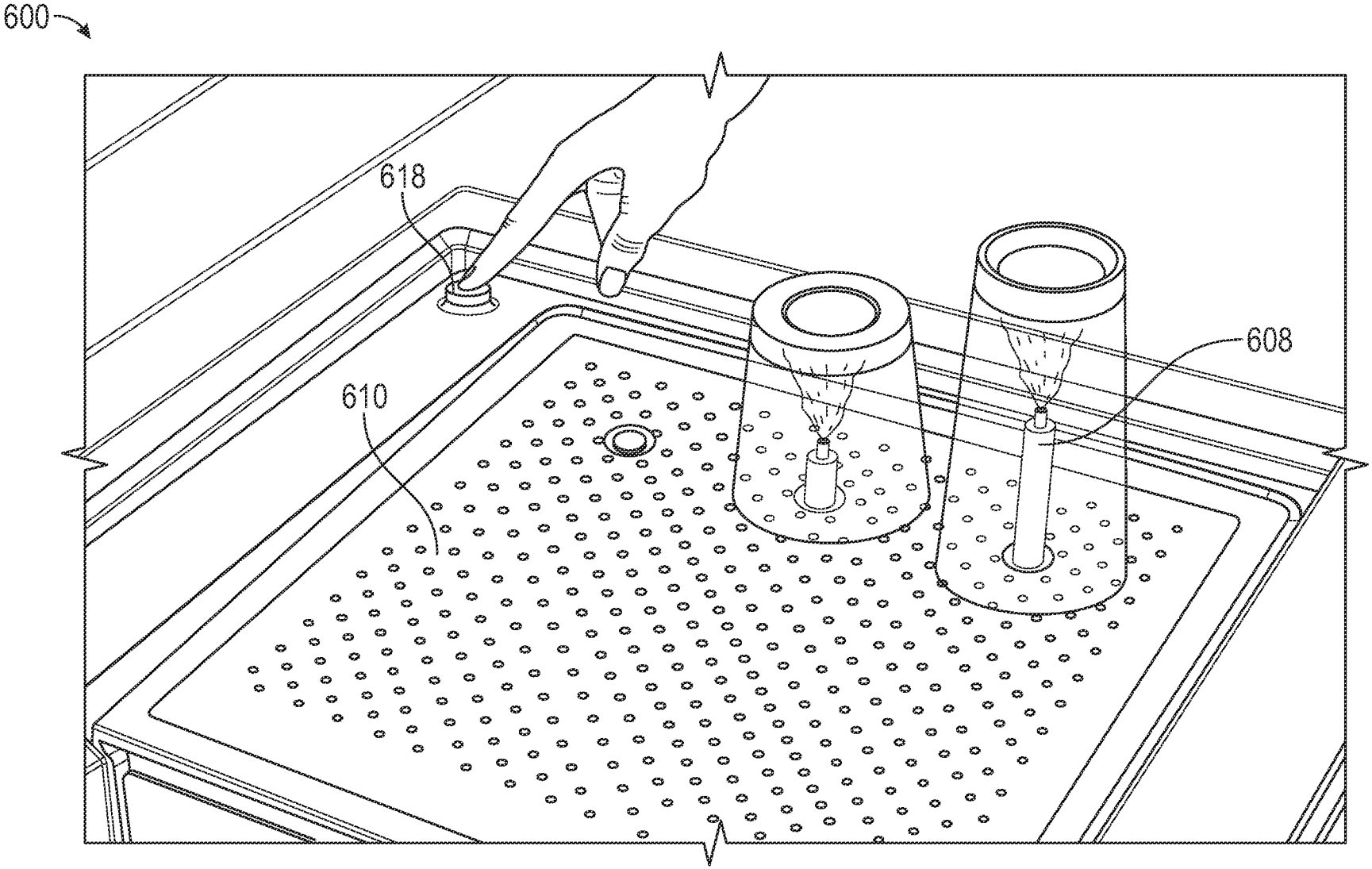
FIG. 6 shows a retractable nozzle feature of a kitchen sink system, according to some embodiments.

FIG. 6 shows a kitchen sink system 600 comprising a retractable nozzle feature. The retractable nozzle feature can include a tray or base surface 610, one or more retractable nozzles 608, and an actuating mechanism 618 configured to control operation of the one or more retractable nozzles 608. As shown, two retractable nozzles 608 are extended upwards from the surface of tray 610. One nozzle extends further upward than the other. This may be used to accommodate items (e.g., drinking glasses) of different sizes/heights. When a user selects actuating mechanism 618, the retractable nozzles can extend upward and dispense pressurized air and/or water. When actuating mechanism is no longer selected, the retractable nozzles 608 may retracted back downwards below the surface of the tray 610, such that the retractable nozzles are flush with a portion of the surface of tray 610. Also, note that although actuating mechanism 618 is shown as a separate button, actuating mechanism 618 may be integrated into retractable nozzle 608, in some embodiments. For example, to actuate an actuating mechanism 618 that is integrated into retractable nozzle 608, a user may press down on the retractable nozzle 608.

The foregoing description sets forth exemplary systems, methods, techniques, parameters, and the like. It should be recognized, however, that such description is not intended as a limitation on the scope of the present disclosure but is instead provided as a description of exemplary embodiments.

Although the description herein uses terms first, second, etc. to describe various elements, these elements should not be limited by the terms. These terms are only used to distinguish one element from another.

The invention claimed is:

1. A kitchen sink system comprising:

a sink basin having a first side surface and a second side surface opposite the first side surface;

a first plurality of nozzles on the first side surface;

a second plurality of nozzles on the second side surface;

an air pump fluidly connected to the first plurality of nozzles and the second plurality of nozzles;

a first actuating mechanism, wherein when the first actuating mechanism is actuated, the air pump pumps air to the first plurality of nozzles and the second plurality of nozzles, and the first plurality of nozzles and the second plurality of nozzles dispense the air received from the air pump into the sink basin;

a base surface proximate to the sink basin, wherein a side edge of the base surface extends from a top portion of the second side surface of the sink basin;

one or more retractable nozzles disposed in the base surface; and a second actuating mechanism, wherein when the second actuating mechanism is actuated, the one or more retractable nozzles are configured to extend vertically from the base surface, and when the second actuating mechanism is not actuated, the one or more retractable nozzles are configured to retract such that a top surface of the one or more retractable nozzles is flush with a portion of the base surface.

2. The kitchen sink system of claim 1, wherein a colander comprising openings on a first side and a second side opposite the first side is sized to fit within the sink basin, and wherein each nozzles of the first plurality of nozzles is aligned with an opening on the first side of the colander and each nozzle of the second plurality of nozzles is aligned with an opening on the second side of the colander such that each nozzles of the first plurality of nozzles and each nozzle of the second plurality of nozzles are configured to dispense air into the colander when it is positioned within the sink basin without interference from the colander.

3. The kitchen sink system of claim 2, wherein when the colander is positioned within the sink basin, a space between an exterior of the first side of the colander and the first side surface of the sink basin is 1-20 mm wide, and a space between an exterior of the second side of the colander and the second side surface of the sink basin is 1-20 mm wide.

4. The kitchen sink system of claim 1, wherein each of the first plurality of nozzles and the second plurality of nozzles comprises 20-50 nozzles.

5. The kitchen sink system of claim 1, wherein the first plurality of nozzles and the second plurality of nozzles are each arranged in a diagonal grid.

6. The kitchen sink system of claim 1, wherein the first actuating mechanism is configured to activate and deactivate the first plurality of nozzles and the second plurality of nozzles.

7. The kitchen sink system of claim 1, wherein the first actuating mechanism is configured to activate the first plurality of nozzles and the second plurality of nozzles, and the first plurality of nozzles and the second plurality of nozzles are configured to deactivate after a predetermined amount of time.

8. The kitchen sink system of claim 1, comprising:

a third plurality of nozzles along a upper portion of the first side surface; and a third actuating mechanism, wherein the third plurality of nozzles are configured to receive water from a water source and, when the third actuating mechanism is actuated, dispense the water across the sink basin such that the dispensed water contacts the second side surface of the sink basin.

9. The kitchen sink system of claim 1, comprising:

a fourth plurality of nozzles along a upper portion of the first side surface; and a fourth actuating mechanism, wherein the fourth plurality of nozzles are configured to receive steam from a steam generator and, when the fourth actuating mechanism is actuated, dispense the steam into the sink basin.

10. A kitchen sink system comprising:

a sink basin having a first side surface and a second side surface opposite the first side surface;

a first plurality of nozzles along an upper portion of the first side surface; and a first actuating mechanism, wherein the first plurality of nozzles are configured to receive steam from a steam generator and, when the first actuating mechanism is actuated, dispense the steam into the sink basin;

a base surface proximate to the sink basin, wherein a side edge of the base surface extends from a top portion of the second side surface of the sink basin;

one or more retractable nozzles disposed in the base surface; and a second actuating mechanism, wherein when the second actuating mechanism is actuated, the one or more retractable nozzles are configured to extend vertically from the base surface, and when the second actuating mechanism is not actuated, the one or more retractable nozzles are configured to retract such that a top surface of the one or more retractable nozzles is flush with a portion of the base surface.

11. The kitchen sink system of claim 10, wherein the first plurality of nozzles comprises 10-30 nozzles.

12. The kitchen sink system of claim 10, wherein the nozzles of the first plurality of nozzles are arranged horizontally in a single layer.

13. The kitchen sink system of claim 10, wherein the first actuating mechanism is configured to activate and deactivate the first plurality of nozzles.

14. The kitchen sink system of claim 10, wherein the first actuating mechanism is configured to activate the first plurality of nozzles, and the first plurality of nozzles are configured to deactivate after a predetermined amount of time.

15. The kitchen sink system of claim 10, comprising:

a second plurality of nozzles on the first side surface;

a third plurality of nozzles on the second side surface;

an air pump fluidly connected to the second plurality of nozzles and the third plurality of nozzles; and a third actuating mechanism, wherein when the third actuating mechanism is actuated, the air pump pumps air to the second plurality of nozzles and the third plurality of nozzles, and the second plurality of nozzles and the third plurality of nozzles dispense the air received from the air pump into the sink basin.

16. A kitchen sink system comprising:

a sink basin having a first side surface and a second side surface opposite the first side surface;

a base surface proximate to the sink basin, wherein a side edge of the base surface extends from a top portion of the second side surface of the sink basin;

one or more retractable nozzles disposed in the base surface; and a first actuating mechanism, wherein when the first actuating mechanism is actuated, the one or more retractable nozzles are configured to extend upwards from the base surface, and when the first actuating mechanism is not actuated, the one or more retractable nozzles are configured to retract such that a top surface of the one or more retractable nozzles is flush with a portion of the base surface.

17. The kitchen sink system of claim 16, wherein the one or more retractable nozzles are configured to extend upwards to a first position and a second position, wherein in the second position, a height of the one or more retractable nozzles is greater than a height of the one or more retractable nozzles in the first position.

18. The kitchen sink system of claim 16, comprising:

a first plurality of nozzles on the first side surface;

a second plurality of nozzles on the second side surface;

an air pump fluidly connected to the first plurality of nozzles and the second plurality of nozzles; and a second actuating mechanism, wherein when the second actuating mechanism is actuated, the air pump pumps air to the first plurality of nozzles and the second plurality of nozzles, and the first plurality of nozzles and the second plurality of nozzles dispense the air received from the air pump into the sink basin.

19. The kitchen sink system of claim 16, comprising:

a third plurality of nozzles along a upper portion of the first side surface; and a third actuating mechanism, wherein the third plurality of nozzles are configured to receive water from a water source and, when the third actuating mechanism is actuated, dispense the water across the sink basin such that the dispensed water contacts the second side surface of the sink basin.

20. The kitchen sink system of claim 16, comprising:

a fourth plurality of nozzles along a upper portion of the first side surface; and a fourth actuating mechanism, wherein the fourth plurality of nozzles are configured to receive steam from a steam generator and, when the fourth actuating mechanism is actuated, dispense the steam into the sink basin.

21. A kitchen sink system comprising:

a sink basin having a first side surface and a second side surface opposite the first side surface;

a first plurality of nozzles on the first side surface;

a second plurality of nozzles on the second side surface;

an air pump fluidly connected to the first plurality of nozzles and the second plurality of nozzles;

a first actuating mechanism, wherein when the first actuating mechanism is actuated, the air pump pumps air to the first plurality of nozzles and the second plurality of nozzles, and the first plurality of nozzles and the second plurality of nozzles dispense the air received from the air pump into the sink basin;

a third plurality of nozzles along a upper portion of the first side surface;

a second actuating mechanism, wherein the third plurality of nozzles are configured to receive water from a water source and, when the actuating mechanism is actuated, dispense the water across the sink basin such that the dispensed water contacts the second side surface of the sink basin;

a fourth plurality of nozzles along a upper portion of the first side surface; and a third actuating mechanism, wherein the fourth plurality of nozzles are configured to receive steam from a steam generator and, when the third actuating mechanism is actuated, dispense the steam into the sink basin; and a base surface proximate to the sink basin, wherein a side edge of the base surface extends from a top portion of the second side surface of the sink basin;

one or more retractable nozzles disposed in the base surface; and a fourth actuating mechanism, wherein when the fourth actuating mechanism is actuated, the one or more retractable nozzles are configured to extend vertically from the base surface, and when the fourth actuating mechanism is not actuated, the one or more retractable nozzles are configured to retract such that a top surface of the one or more retractable nozzles is flush with a portion of the base surface.

* * * * *